US006044902A

United States Patent [19]

Pahade et al.

[11] Patent Number: 6,044,902

[45] Date of Patent: Apr. 4, 2000

[54] HEAT EXCHANGE UNIT FOR A CRYOGENIC AIR SEPARATION SYSTEM

[75] Inventors: Ravi Fulchand Pahade, Getzville; Bayram Arman; Michael James Lockett, both of Grand Island, all of N.Y.

[73] Assignee: Praxair Technology, Inc., Danbury, Conn.

[21] Appl. No.: 08/914,785

[22] Filed: Aug. 20, 1997

[51] Int. Cl.[7] ..... F28F 3/00

[52] U.S. Cl. ..... 165/166; 165/140; 165/165; 62/903

[58] Field of Search ..... 165/166, 140, 165/165; 62/903

[56] References Cited

U.S. PATENT DOCUMENTS

| | | | |
|---|---|---|---|
| 3,225,823 | 12/1965 | Fröhlich | 165/166 |
| 3,559,722 | 2/1971 | Schauls et al. | 165/166 X |
| 3,983,191 | 9/1976 | Schauls | 165/166 X |
| 3,992,168 | 11/1976 | Toyama et al. | 165/166 X |
| 4,131,159 | 12/1978 | Long | 165/166 |
| 4,330,308 | 5/1982 | Grenier et al. | 165/140 X |
| 5,108,476 | 4/1992 | Dray et al. | 62/30 |
| 5,144,809 | 9/1992 | Chevalier et al. | 165/166 |
| 5,275,004 | 1/1994 | Agrawal et al. | 62/24 |
| 5,438,836 | 8/1995 | Srinivasan et al. | 62/36 |
| 5,537,840 | 7/1996 | Srinivasan et al. | 62/643 |
| 5,592,832 | 1/1997 | Herron et al. | 62/903 X |
| 5,596,883 | 1/1997 | Bernhard et al. | 62/903 X |
| 5,613,373 | 3/1997 | Grenier | 165/166 X |

*Primary Examiner*—Christopher Atkinson
*Attorney, Agent, or Firm*—Stanley Ktorides

[57] ABSTRACT

A heat exchanger having a first counterflow heat exchange unit with first and second segments wherein a flow of at least one product from a cryogenic air separation unit is channeled in a first direction along both the first and second segments and a second counterflow heat exchange unit is juxtaposed to the second segment of the first counterflow heat exchange unit and receives a flow of feed air which is channeled in a second direction that is counter to the first direction and allows heat exchange between the product and the air. A crossflow subcooling unit is juxtaposed to the first segment and receives at least one process cryogenic liquid from the air separation system for subcooling.

9 Claims, 8 Drawing Sheets

HEAT EXCHANGE UNIT FOR A CRYOGENIC AIR SEPARATION SYSTEM

FIELD OF THE INVENTION

This invention relates generally to cryogenic air separation systems and, more particularly, to an improved heat exchange unit for use in such a cryogenic air separation system.

BACKGROUND OF THE INVENTION

FIG. 1 illustrates a prior art cryogenic air separation system 10 which produces gaseous oxygen, gaseous nitrogen and liquid oxygen. In system 10, a stream S4 of high pressure feed air passes through a primary heat exchanger 12 where it is cooled by indirect heat exchange against return streams S3 of product gaseous oxygen, S2 of waste nitrogen and S1 of product nitrogen. A second, lower pressure feed air stream S5 also passes through and is cooled by indirect heat exchange in primary heat exchanger 12. Air stream S5 is turbo expanded and is fed to a high pressure column 14. High pressure air stream S4, after exiting from primary heat exchanger 12, passes through an oxygen boiler 16, where heat exchange occurs as a result of flow of a liquid oxygen stream 18 from pump 20.

Within column 14, the air feeds undergo a preliminary separation into liquid fractions of crude oxygen and substantially pure nitrogen. The nitrogen outflow passes via pipe 22 through a condenser/reboiler 24. A portion of the resultant nitrogen-rich liquid stream S7 then is passed through subcooler 26 and is fed as a liquid reflux to the top of low pressure column 28.

The crude oxygen fraction from lower column 14 is fed via pipe 30 as stream S6 through subcooler 26 and into a side feed of upper column 28. Within upper column 28, the fluids are separated by cryogenic distillation into a nitrogen-rich vapor and an oxygen-rich liquid. The nitrogen-rich vapor is withdrawn from upper column 28 via pipe 32, is passed through subcooler 26 and primary heat exchanger 12, to exit as product nitrogen gas stream S1. A waste nitrogen stream emerges from upper column 28 via pipe 34 and proceeds through the same route to waste nitrogen stream output S2. The oxygen-rich liquid is removed from the bottom of low-pressure column 24 via pipe 36. Another portion of oxygen-rich liquid is removed via pipe 37, pumped to a higher pressure by pump 20 and is then vaporized and warmed to obtain product oxygen stream S3. Further details of the operation air separation system 10 can be found in U.S. Pat. No. 5,108,476 to Dray et al.

As can be seen from an examination of air separation system 10, the cryogenic distillation of air is a process which requires extensive heat integration and exchange between various inlet and outlet streams. The heat exchange processes can be classified as follows:

1) Primary heat exchange (occurring in primary heat exchanger 12) wherein the incoming feed air is cooled down to the process temperatures against product and waste streams;
2) Product oxygen boiling (in oxygen boiler 16) where liquid oxygen product is boiled against a condensing air stream S4;
3) Subcooling of liquid streams (occurring in subcooler 26) where cold product and waste streams are warmed against various liquid streams; and
4) Reboiling/condensing (in unit 24) where a nitrogen-rich vapor condenses against an oxygen-rich liquid.

The provision of individual, separate heat exchange units to provide the necessary heat transfer functions constitutes a substantial expense item in air separation system 10. The art is replete with various designs for improved heat exchange units. One such design is shown in U.S. Pat. No. 5,438,836 to Srinivasan et al., which discloses a downflow, reboiling/condensing, plate and fin heat exchanger wherein nitrogen-rich vapor condenses against an oxygen-rich liquid stream.

Agrawal et al., in U.S. Pat. No. 5,275,004, suggest performing a reboiling/condensing heat exchange in the primary heat exchanger and that the primary heat exchanger can also include the subcooling heat exchange function. The heat exchange unit described by Agrawal et al. employs a counterflow configuration, wherein streams to be heat exchanged flow in opposite directions through the exchange structure.

A significant problem with the heat exchange structure taught by Agrawal et al. is that its implementation in a size suitable for incorporation into an operating cryogenic separation plant leads to an exchanger with total core lengths that are costly and difficult to manufacture.

Accordingly, it is an object of this invention to provide a heat exchange unit for an air separation system wherein the number of heat exchange cores is reduced.

It is another object of this invention to reduce waste and product stream pressure drops as a result of the use of shorter heat exchange sections, including subcooling sections.

It is a further object of this invention to reduce the number of headers required for coupling of feed streams to the heat exchange system.

SUMMARY OF THE INVENTION

A heat exchanger incorporating the invention includes a first counterflow heat exchange unit with first and second segments. A flow of at least one product from an air separation unit is channeled in a first direction along both the first and second segments. A second counterflow heat exchange unit is juxtaposed to the second segment of the first counterflow heat exchange unit and receives a flow of feed air. The feed air is channeled in a second direction that is counter to the first direction and allows heat exchange between the product and the air. A crossflow subcooling unit is juxtaposed to the first segment and receives at least one process cryogenic liquid from the air separation system. The resulting crossflow of the one process cryogenic liquid with respect to the product flowing in the first segment achieves a heat transfer which subcools the one process cryogenic liquid.

The numerals in the Figures are the same for similar or common elements.

DETAILED DESCRIPTION OF THE INVENTION

Figure 1:
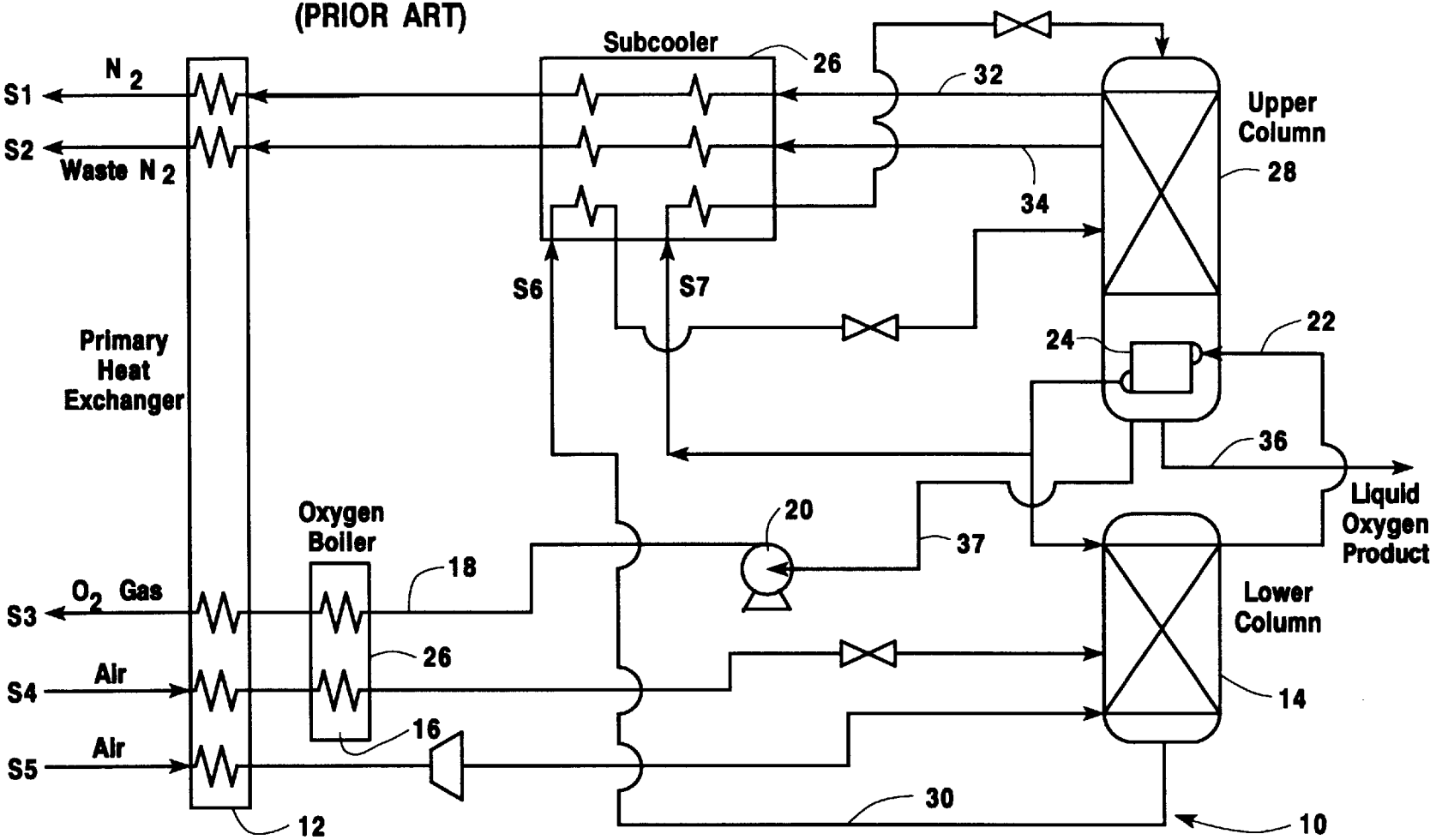
Fig. 1 (PRIOR ART)
FIG. 1 is a system diagram of a prior art air separation system.
Figure 2:
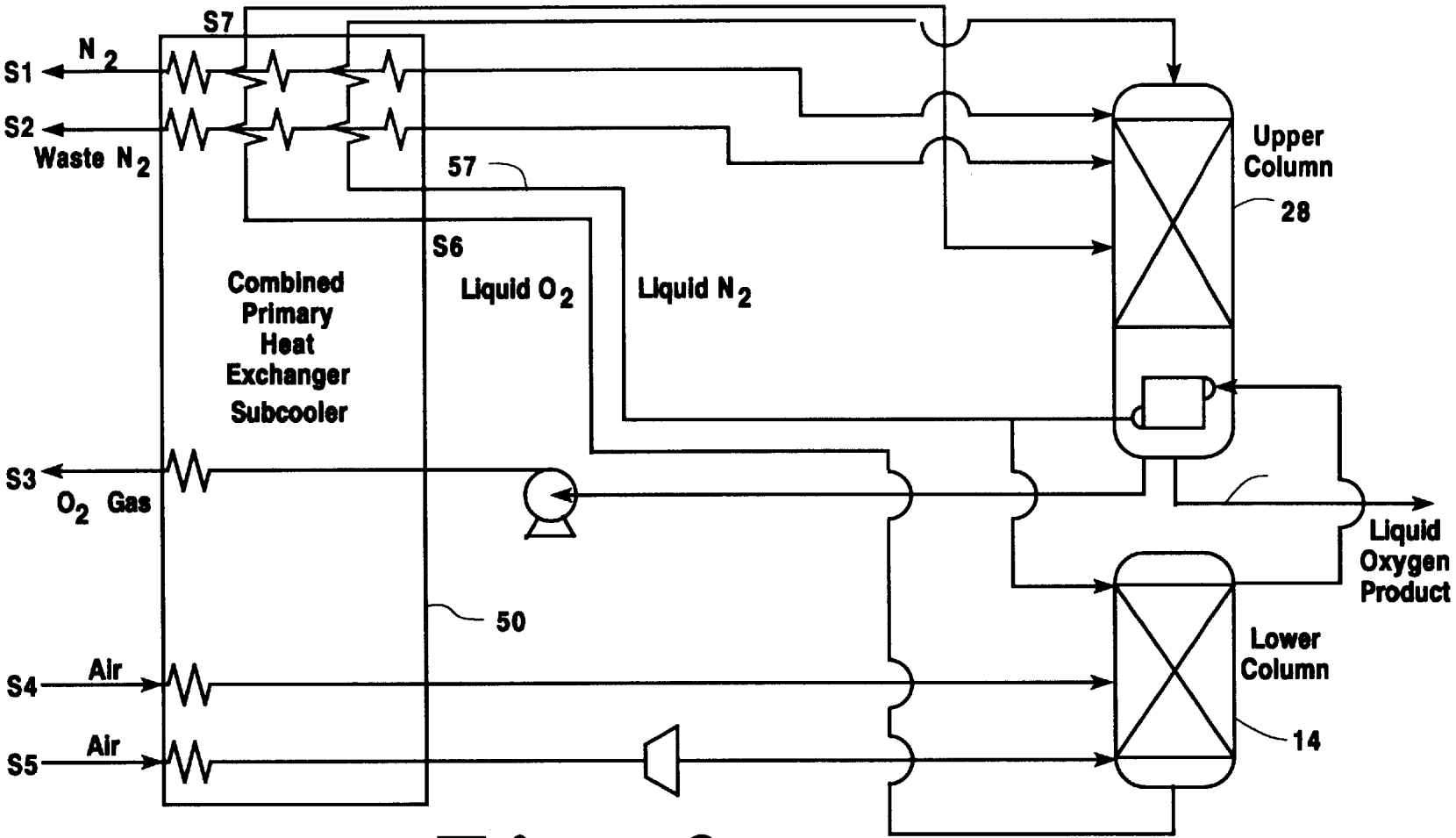
FIG. 2 is a schematic system diagram of an air separation system employing a combined primary heat exchange/subcooling system which incorporates the invention hereof.

Referring to FIG. 2, streams S1–S7 are functionally identical to those described in FIG. 1, as are lower and upper columns 14 and 28, respectively. In the air separation system of FIG. 2, however, the primary heat exchanger, the oxygen boiler and the subcooler have been incorporated into a single primary heat exchange/subcooler 50, (hereafter referred to as "primary unit" 50). In brief, primary unit 50 includes at least two parts, i.e., a counterflow part A and a crossflow part B (to be described in detail with respect to FIGS. 3–6). Parts A and B are adjacent to each other, with counterflow part A enabling the cooling of air streams S4 and S5 by virtue of counterflows of product oxygen stream S3 and nitrogen streams S1 and S2. Crossflow section B enables the subcooling of process liquid nitrogen stream S7 and process liquid oxygen stream S6 against nitrogen and nitrogen waste streams S1 and S2.

Figure 3:
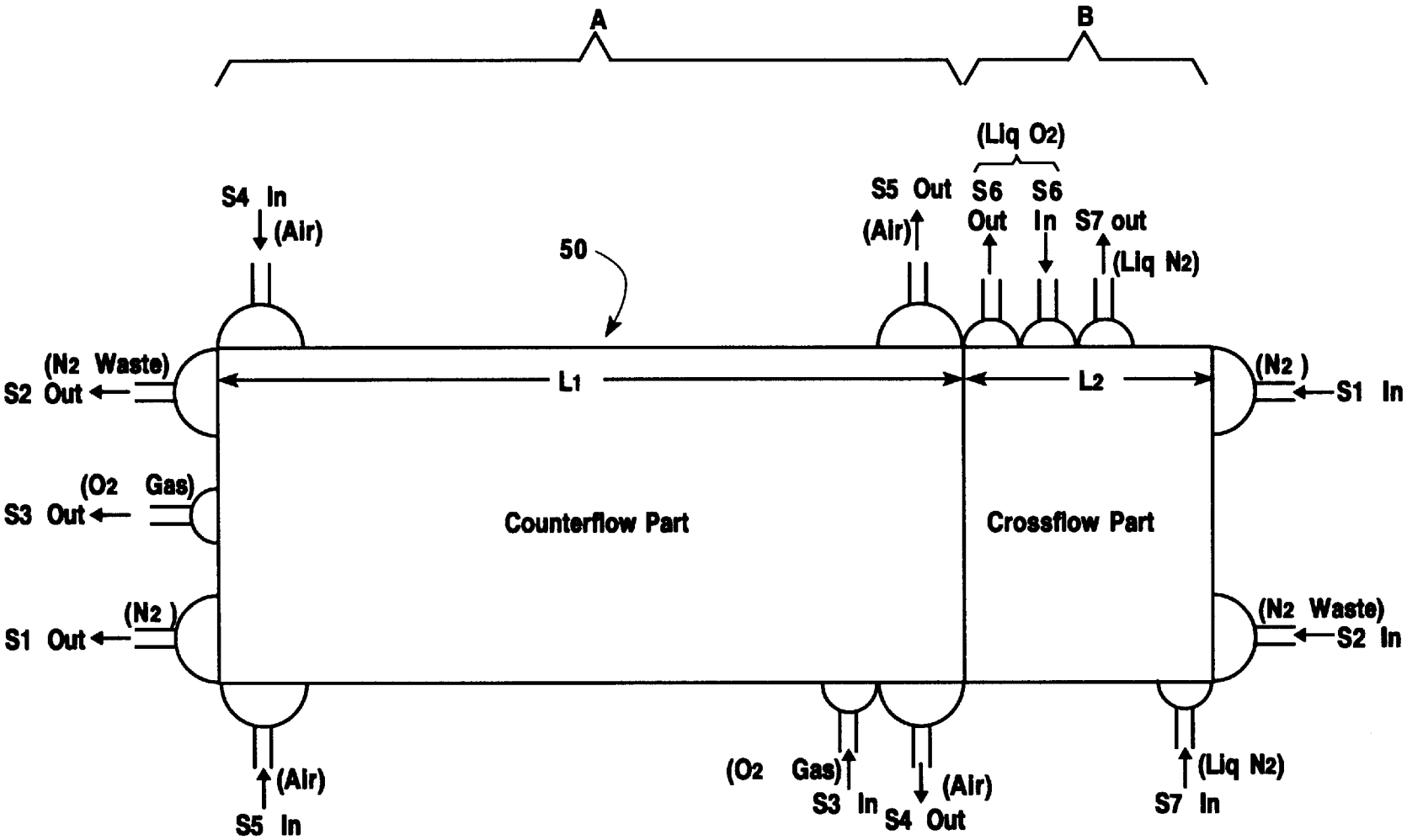
FIG. 3 is a schematic illustration of the combined primary heat exchange/subcooling unit (hereafter the "primary unit") of the invention, showing the header arrangement therefor.
Figure 4:
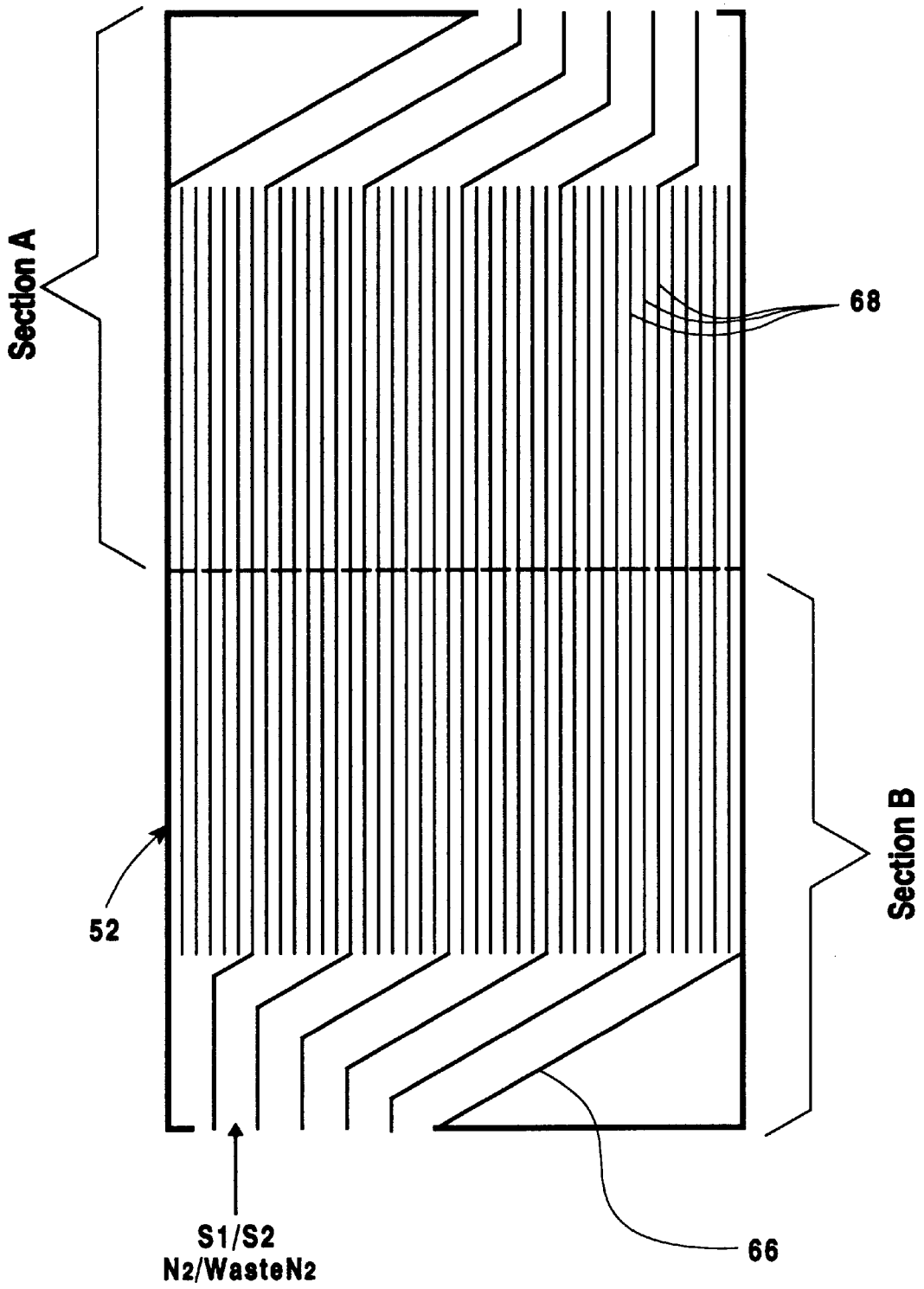
FIG. 4 illustrates a schematic plan view of a first counterflow segment of the primary unit.
Figure 5:
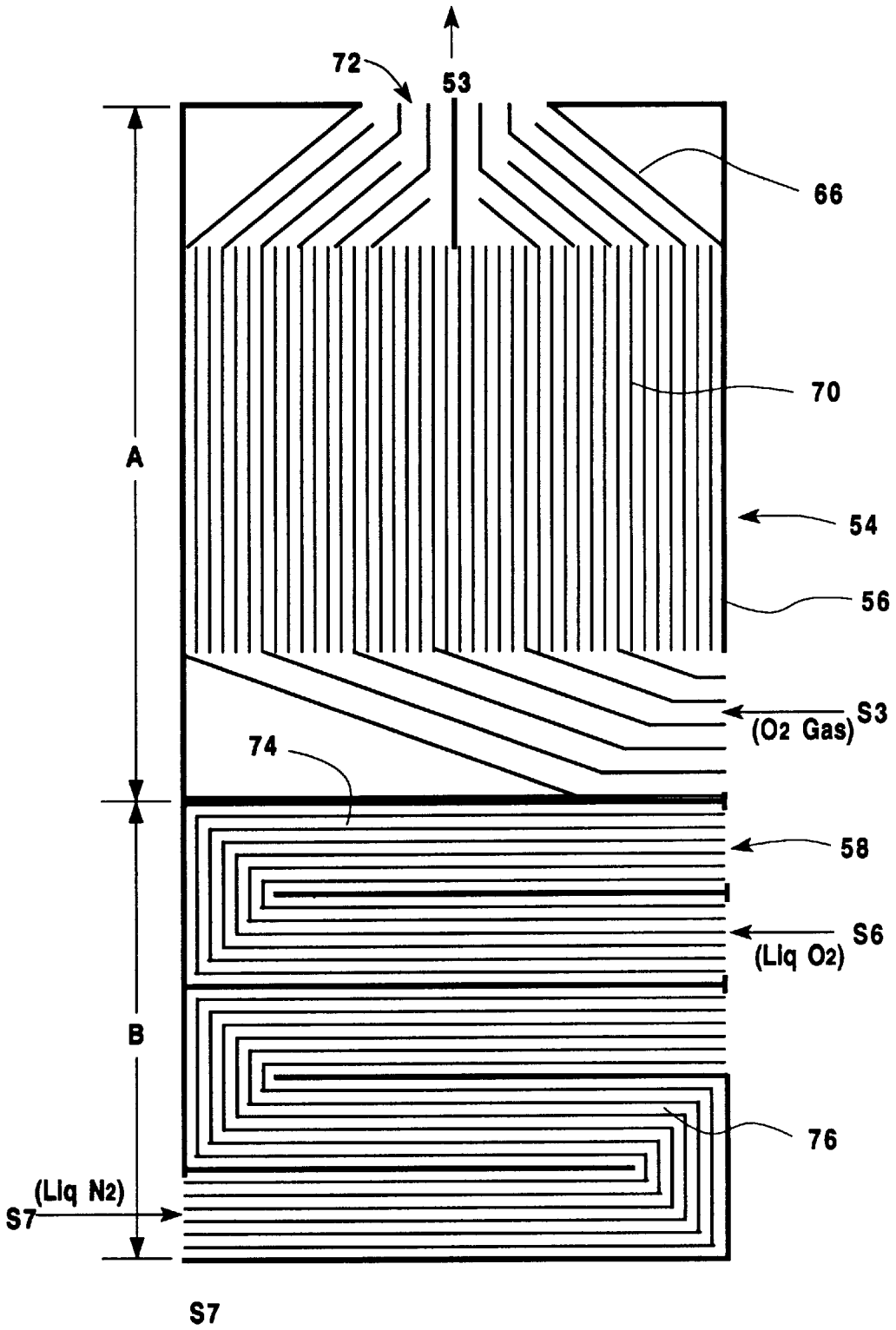
FIG. 5 is a schematic plan view of a second counterflow/crossflow segment of the primary unit.
Figure 6:
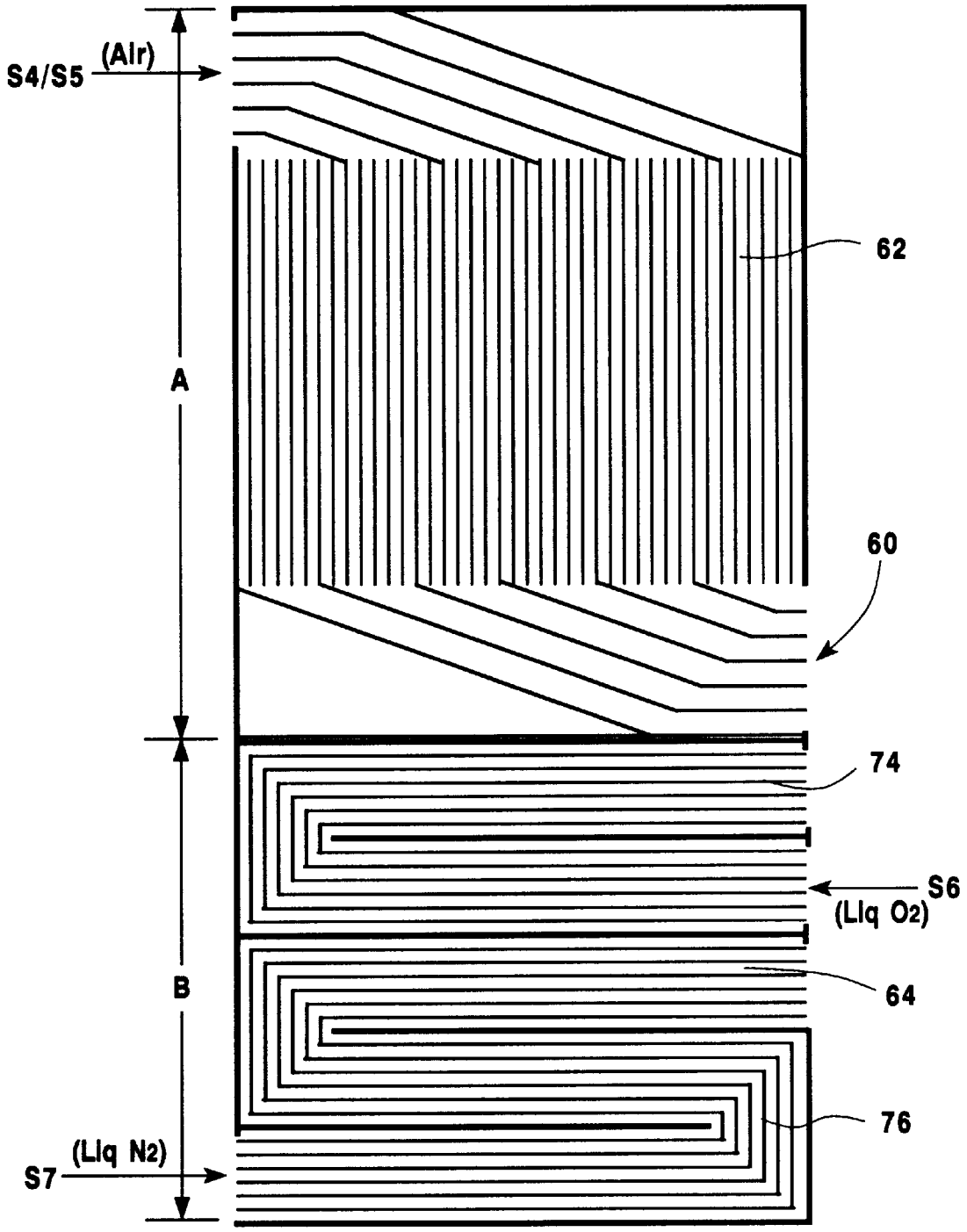
FIG. 6 is a schematic plan view of a third counterflow/crossflow segment of the primary unit.

Referring to FIG. 3, the overall structure of primary unit 50 will be described in conjunction with FIGS. 4–6 which show counterflow and crossflow heat exchange layers thereof. FIG. 3 illustrates the header arrangements which enable flow of the various counterflow and crossflow streams to and from primary unit 50. FIG. 4 shows a uniaxial flow heat exchange layer 52. FIG. 5 shows a counterflow/crossflow heat exchange layer 54 which includes counterflow segment 56 and crossflow segment 58. FIG. 6 shows a still further counterflow/crossflow segment heat exchange layer 60 which includes counterflow segment 62 and crossflow segment 64. Those skilled in the art will realize that multiple copies of heat exchange layers 52, 54 and 60, may be combined to create primary unit 50.

Returning to FIGS. 3 and 4, nitrogen and nitrogen waste streams S1 or S2 enter from the bottom of heat exchange layer 52 and are channeled to flow upwardly by plural distributor fins 66, into a multiplicity of channels created by adjacent heat transfer fins 68. Heat transfer fins 68 are integral with parting sheets (not shown) which sandwich both sides of heat exchange layer 52 and enable a transfer of heat between adjacent layers of primary unit 50. Section A of heat exchange layer 52 comprises the counterflow portion and section B comprises the crossflow portion.

Shown in FIG. 5 is counterflow/crossflow heat exchange layer 54 which is sandwiched to heat exchange layer 52 of FIG. 4. Section A thereof receives product oxygen stream S3 which flows through channels defined by heat transfer fins 70 and exits via output port 72. In crossflow section B, process liquid oxygen stream S6 flows into crossflow section 74 while process liquid nitrogen stream S7 flows into crossflow section 76. Note that crossflow sections 74 and 76 channel the liquid flows in directions that are generally transverse to section B of heat exchange layer 52 shown in FIG. 4 (which is sandwiched immediately adjacent thereto).

In similar fashion, counterflow/crossflow heat exchange layer 60 (FIG. 6) includes a counterflow section A wherein air streams S4 or S5 flow in a counterdirection to the flow directions of nitrogen and waste nitrogen streams S1 and S2 in heat exchange layer 52. Crossflow sections 74 and 76 are identical to those shown in FIG. 5 and receive process liquid oxygen stream as S6 and process liquid nitrogen stream S7, respectively.

Primary unit 50, utilizing heat exchange layers 52, 54 and 60 arranged in a sandwich fashion, achieves subcooling in section B of process liquid oxygen and liquid nitrogen streams S6 and S7 against product nitrogen stream S1 and waste nitrogen stream S2. Counterflow cooling of inlet air streams S4, S5 in section A is achieved against nitrogen stream S1 and nitrogen waste stream S2 and product oxygen stream S3.

The length of counterflow section A in primary unit 50 is denoted L1 and the length of crossflow section B is denoted L2. The most useful designs of primary unit 50 result when the ratio L2/(L1+L2) is in the range of 0.005 to 0.09 or the range of 0.10 to 0.30.

Figure 7:
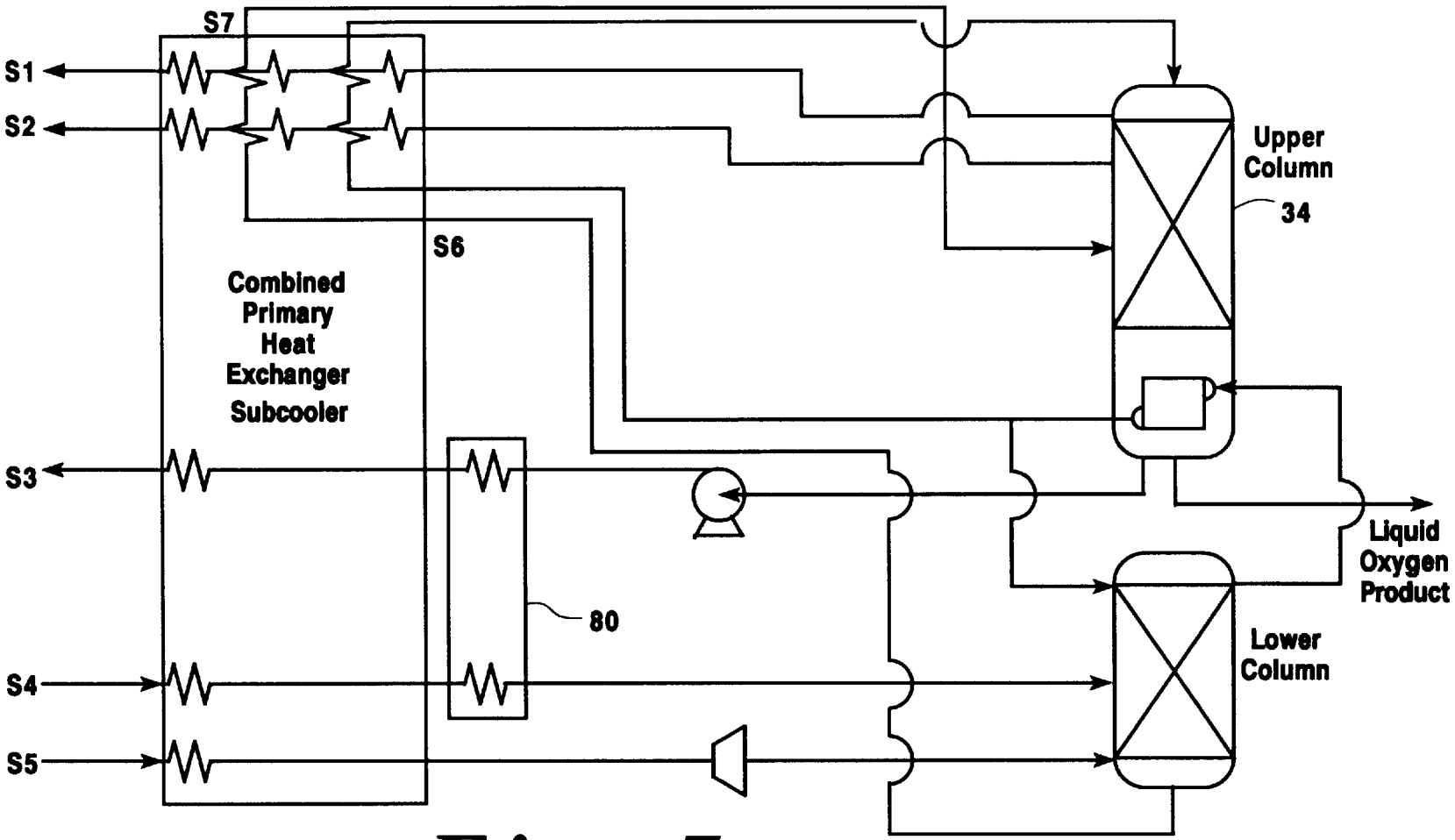
FIG. 7 illustrates a cryogenic air separation system with a limited combined duty heat exchange unit incorporating the invention.
Figure 8:
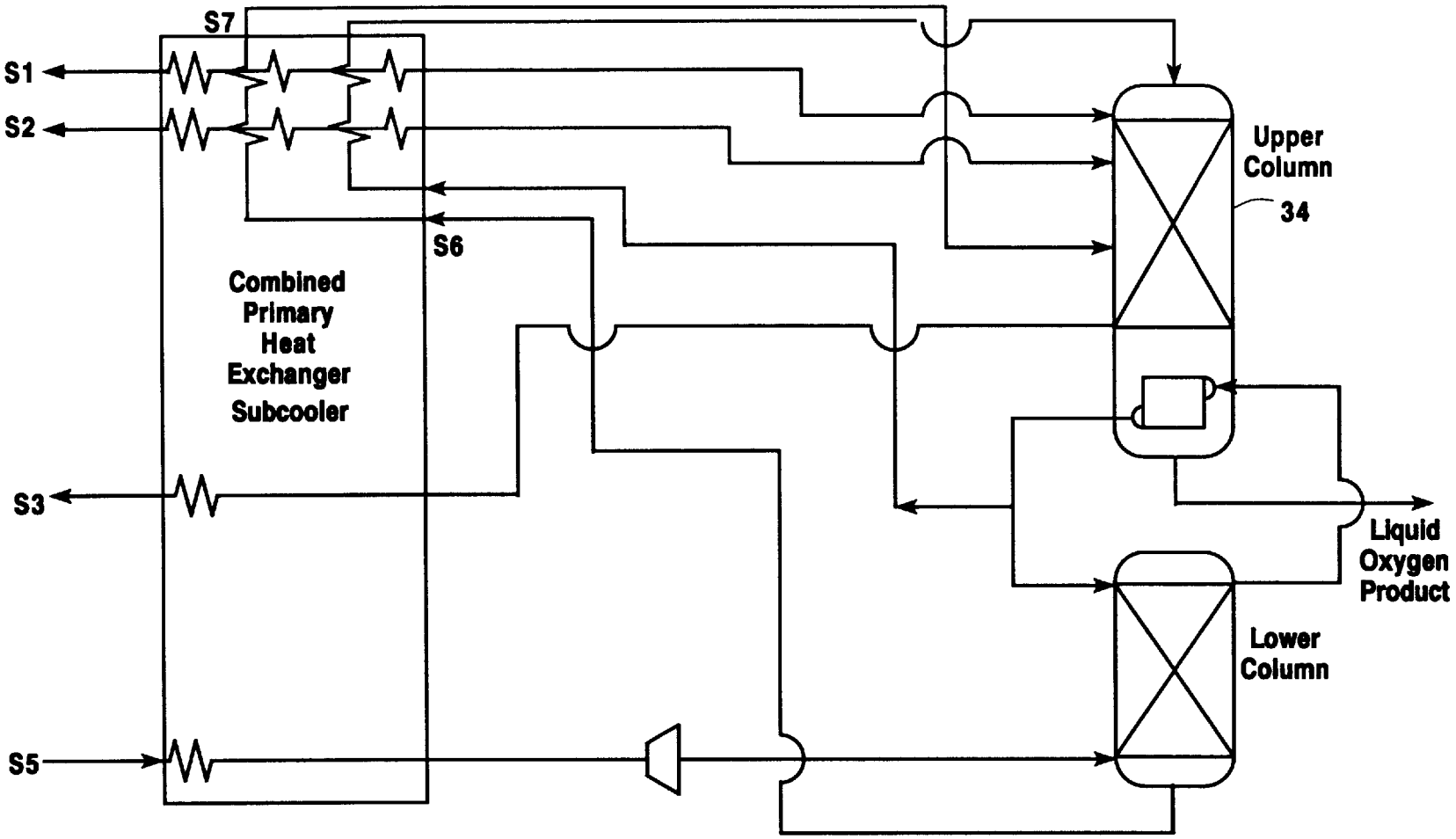
FIG. 8 illustrates a cryogenic air separation system with a combined duty heat exchange unit and without a product oxygen boiler.

The structure of primary unit 50 enables the application thereof to a variety of sizes of air separation plants. In some applications (see FIG. 7), it may be desirable to have a separate product oxygen boiler. In such case, only the primary heat exchanger and subcooler portions are combined in primary unit 50 and a separate oxygen boiler 80 is employed. Oxygen boiler 80 enables counterflow heat exchange between high pressure air stream S4 and the oxygen-rich liquid flow from upper column 34. In other applications (see FIG. 8), the process may not use an oxygen product boiler. In such a case, oxygen taken directly from the upper column is warmed in the primary heat exchanger and is output as oxygen gas stream S3.

In an alternative arrangement (see FIG. 2), a portion of high pressure air stream S4, after it leaves heat exchanger 50, can be split off and returned to the crossflow part of the heat exchanger. There the cooled air stream is condensed against streams S1 and/or S2 to provide a further condensed air flow.

The heat exchange arrangement described above results in the achievement of power savings through reduced pressure drops, capital savings through the reduction in the number of exchange cores and headers and a reduction in the footprint of the plant, due to the layered structure of the unit.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A heat exchanger cryogenic air separation system combination, comprising:

a first heat exchange unit including a first segment and a second segment, for receiving a flow of at least one cryogenic product from an air separation system and for channeling said flow in a first direction along said first segment and said second segment;

a second heat exchange unit comprising first and second portions, said first portion in heat exchange communication with said first segment and said second portion in heat exchange communication with said second segment, (i) said second portion receiving a flow of air and channeling said flow of air in a counterflow direction to flow of said at least one cryogenic product in said second segment and (ii) said first portion arranged to enable flow therethrough to be a crossflow in said first segment, said first portion receiving at least one process cryogenic liquid from said air separation system and providing a crossflow thereof with respect to flow of said at least one cryogenic product in said first segment, to achieve a subcooling of said at least one process cryogenic liquid; and a subcooling unit comprising a third portion and a fourth portion, said third portion in heat exchange communication with said first segment and said fourth portion in heat exchange communication with said second segment, (i) said fourth portion receiving a flow of product gas from said air separation system and channeling said flow of product gas in a co-flow direction to flow of said at least one cryogenic product in said second segment and (ii) said third portion arranged to enable flow therethrough to be a crossflow in said first segment, said third portion receiving at least one process cryogenic liquid from said air separation system and providing a crossflow thereof with respect to flow of said at least one cryogenic product in said first segment, to achieve a subcooling of said at least one process cryogenic liquid.

2. The heat exchanger as recited in claim 1, wherein said first portion and third portion both receive a second process cryogenic liquid from said air separation system and provide a crossflow thereof with respect to flow of said at least one cryogenic product in said first segment, to achieve a subcooling of said second process cryogenic liquid.

3. The heat exchanger as recited in claim 1, wherein said first segment exhibits a heat exchange length L2 and said second segment exhibits a heat exchange length L1 and L2/(L1+L2) is in a range of about 0.005 to 0.09.

4. The heat exchanger as recited in claim 1 wherein said first segment has a heat exchange length L2 and said second section has a heat exchange length L1 and L2/(L1+L2) is in a range of about 0.10 to 0.30.

5. The heat exchanger as recited in claim 1, wherein said at least one cryogenic product that flows in said first heat exchange unit is nitrogen.

6. The heat exchanger as recited in claim 1, wherein said at least one process cryogenic liquid is an oxygen-rich liquid and said second process cryogenic liquid is a nitrogen-rich liquid.

7. The heat exchanger as recited in claim 1, wherein said product gas that flows in said fourth portion is oxygen.

8. A heat exchange method comprising the steps of:

flowing at least one cryogenic product from a cryogenic air separation system in a first direction along a first segment and a second segment of a first heat exchange unit;

channeling a flow of feed air to said air separation system in a counterflow direction to flow of said at least one cryogenic product in said second segment, said counterflow occurring in a second portion of a second heat exchange unit that is in heat exchange communication with said second segment, to achieve a cooling of said feed air;

channeling a flow of at least one process cryogenic liquid from said air separation system in a crossflow direction to flow of said at least one cryogenic product in said first segment, said crossflow occurring in a first portion of said second heat exchange unit that is in heat exchange communication with said first segment, said crossflow achieving a subcooling of said at least one process cryogenic liquid;

flowing a product gas from said air separation system through a portion of a subcooling unit that is in heat exchange communication with said second segment and channeling said flow of product gas in a co-flow direction to flow of said at least one cryogenic product in said second segment; and providing a crossflow through another portion of said subcooling unit of at least one process cryogenic liquid from said air separation system thereof with respect to flow of said at least one cryogenic product in said first segment, said another portion in heat exchange communication with said first segment, to achieve a subcooling of said at least one process cryogenic liquid.

9. The method as recited in claim 8, comprising the added step of:

flowing a second process cryogenic liquid from said air separation system through said another portion of said subcooling unit, in a crossflow direction with respect to flow of said at least one cryogenic product in said first segment, to achieve a subcooling of said second process cryogenic liquid.

* * * * *